United States Patent [19]

Otsuka et al.

[11] Patent Number: 4,611,790

[45] Date of Patent: Sep. 16, 1986

[54] DEVICE FOR RELEASING AND DIFFUSING BUBBLES INTO LIQUID

[75] Inventors: Ryotatsu Otsuka, Osaka; Shigemi Tanimoto; Kazuo Toyoda, both of Izumi, all of Japan

[73] Assignee: Showa Aluminum Corporation, Sakai, Japan

[21] Appl. No.: 714,427

[22] Filed: Mar. 21, 1985

[30] Foreign Application Priority Data

Mar. 23, 1984 [JP] Japan ..... 59-57120

[51] Int. Cl.[4] ..... C22B 9/05; B01F 3/04

[52] U.S. Cl. ..... 266/235; 266/217; 261/87

[58] Field of Search ..... 266/217, 265, 266, 235, 266/233; 75/68 R, 59.1; 261/87

[56] References Cited

U.S. PATENT DOCUMENTS

| | | | |
|---|---|---|---|
| 2,609,189 | 9/1952 | Dering | 261/87 |
| 3,227,547 | 1/1966 | Szekely | 266/217 |
| 4,078,026 | 3/1978 | Fallenius | 261/87 |
| 4,283,357 | 11/1981 | Sidery | 261/87 |

FOREIGN PATENT DOCUMENTS

| | | | |
|---|---|---|---|
| 551354 | 10/1956 | Belgium | 261/87 |

*Primary Examiner*—L. Dewayne Rutledge

*Assistant Examiner*—Robert L. McDowell

*Attorney, Agent, or Firm*—Armstrong, Nikaido, Marmelstein & Kubovcik

[57] ABSTRACT

A device comprising a rotary shaft to be disposed in a liquid substantially vertically and rotatable about its own axis, the rotary shaft having a gas channel extending therethrough axially of the shaft, and a rotor fixed to the lower end of the rotary shaft and having at its bottom surface a gas discharge outlet communicating with the gas channel. The rotor is formed in its bottom surface with radial grooves extending from the gas outlet to the peripheral surface of the rotor and each having an open end at the peripheral surface. A recess is formed in the peripheral surface between the open ends of immediately adjacent grooves and has an open lower end at the bottom surface. When the rotary shaft is rotated in a liquid while supplying a gas to the gas channel of the shaft, the gas flows out from the discharge outlet into the radial grooves and is released from the open ends of the grooves at the peripheral surface into the liquid in the form of finely divided bubbles. The bubbles are diffused through the entire body of the liquid by the liquid flowing in the centrifugal direction while revolving in the same direction as the rotor owing to the agitating action of the recesses in the rotor peripheral surface.

5 Claims, 6 Drawing Figures

DEVICE FOR RELEASING AND DIFFUSING BUBBLES INTO LIQUID

BACKGROUND OF THE INVENTION

The present invention relates to a device for releasing finely divided bubbles of a gas into a liquid placed in a container and diffusing the bubbles through the entire body of the liquid.

The term "inert gas" as used herein and in the appended claims includes argon gas, helium gas, krypton gas and xenon gas of the Periodic Table and also nitrogen gas which is inert to aluminum and aluminum alloys.

There are cases wherein a gas needs to be released into a liquid in the form of finely divided bubbles. For example, a treating gas must be released into molten aluminum or a molten aluminum alloy in the form of bubbles in order to remove from the melt dissolved hydrogen gas, nonmetallic inclusions such as aluminum and magnesium oxides, and alkali metals such as potassium, sodium and phosphorus. Further for an accelerated chemical reaction, a gas is released into a liquid in the form of bubbles to contact the gas with the liquid. To assure satisfactory contact between the gas and the liquid in these cases, it is required to finely divide bubbles to the greatest possible extent and diffuse the bubbles into the liquid uniformly.

Accordingly, a device has heretofore been used which comprises a vertical rotary shaft disposed in a container for a liquid and internally formed with an axial gas supply channel, and a rotor attached to the lower end of the shaft. The gas supply channel has an open lower end at the bottom surface of the rotor. The rotor is formed in its bottom surface with a plurality of grooves extending radially from the channel open end to the periphery of the bottom. In the peripheral surface of the rotor where the radial grooves have there openings, vertical grooves are formed each of which has a lower end communicating with the radial groove and an open upper end at the top surface of the rotor (see U.S. Pat. No. 3,227,547, FIGS. 14 and 15). When the rotary shaft is rotated by drive means while a gas is being supplied from the gas supply channel to the radial grooves in the bottom surface of the rotor, the gas flows in the centrifugal direction through the radial grooves into the vertical grooves in the peripheral surface of the rotor, from which the gas is released into the liquid in the form of finely divided bubbles.

However, our research and experiments have revealed that the conventional device is not satisfactory in its bubble dividing and diffusing effects for the following reason. When the rotor is rotated, the liquid in the container flows also in the same direction as the rotor at a speed lower than the speed of rotation of the rotor. The greater the difference between the two speeds, the greater is the bubble dividing action. Nevertheless, the speed difference of the conventional device is not very great because the radial grooves in the bottom surface of the rotor are in communication with the vertical grooves in the peripheral surface. Moreover, if the amount of gas to be released increases, the vertical grooves, which are filled with the gas, encounter difficulty in producing finely divided bubbles and fail to exert a sufficient agitating action and to diffuse the bubbles into the liquid efficiently.

SUMMARY OF THE INVENTION

The main object of the present invention is to provide a device which is superior to the conventional device in bubble dividing and diffusing effects.

The device of the present invention for releasing and diffusing bubbles comprises a rotary shaft to be disposed in a liquid substantially vertically and rotatable about its own axis, the rotary shaft having a gas channel extending therethrough axially of the shaft, and a rotor fixed to the lower end of the rotary shaft and having at its bottom surface a gas discharge outlet communicating with the gas channel. The rotor is formed in its bottom surface with radial grooves extending from the gas outlet to the peripheral surface of the rotor and each having an open end at the peripheral surface. A recess is formed in the peripheral surface between the open ends of immediately adjacent grooves and has an open lower end at the bottom surface.

When the shaft is rotated in a liquid while supplying a gas to the gas channel, the gas flows out from the discharge outlet into the radial grooves and is released from the open ends of the grooves at the peripheral surface into the liquid in the form of finely divided bubbles. The bubbles are diffused through the entire body of the liquid by the liquid flowing in the centrifugal direction while revolving in the same direction as the rotor owing to the agitating action of the recesses in the rotor peripheral surface. Since the radial grooves in the rotor bottom surface are not in communication with the recesses in the peripheral surface, the difference between the rotational speed of the rotor and the speed of flow of the liquid when bubbles are released from the peripheral open ends of the radial grooves is greater than in the conventional device. The present device is therefore superior to the conventional device in bubble dividing and dispersing effects.

With the device described above, the recess in the peripheral surface of the rotor is one at least having an open lower end at the bottom surface of the rotor. The recess may be in the form of a groove extending over the entire height of the peripheral surface, or may extend from the lower end of the peripheral surface to a specified height.

The bubble dividing effect improves with an increase in the diameter or rotational speed of the rotor, while the diffusing effect improves with an increase in the size of the recess or in the thickness of the rotor. These factors are determined suitably in accordance with the size of the liquid container, the kind of liquid, etc.

Preferably, the container, rotary shaft and rotor are made of a material which is inactive to the liquid to be placed in the container and to the gas to be introduced into the liquid.

Preferably, the gas to be released and diffused into the liquid is an inert gas, chlorine gas, or a mixture of chlorine gas and an inert gas when removing hydrogen gas and nonmetallic inclusions from molten aluminum or aluminum alloy. For removing alkali metals from the melt, the gas is preferably chlorine gas or a mixture of chlorine gas and an inert gas.

The present invention will be described in greater detail with reference to the accompanying drawings.

DESCRIPTION OF THE PREFERRED EMBODIMENTS

Throughout FIG. 1 to FIG. 4, like parts are referred to by like numerals.

Figure 1:
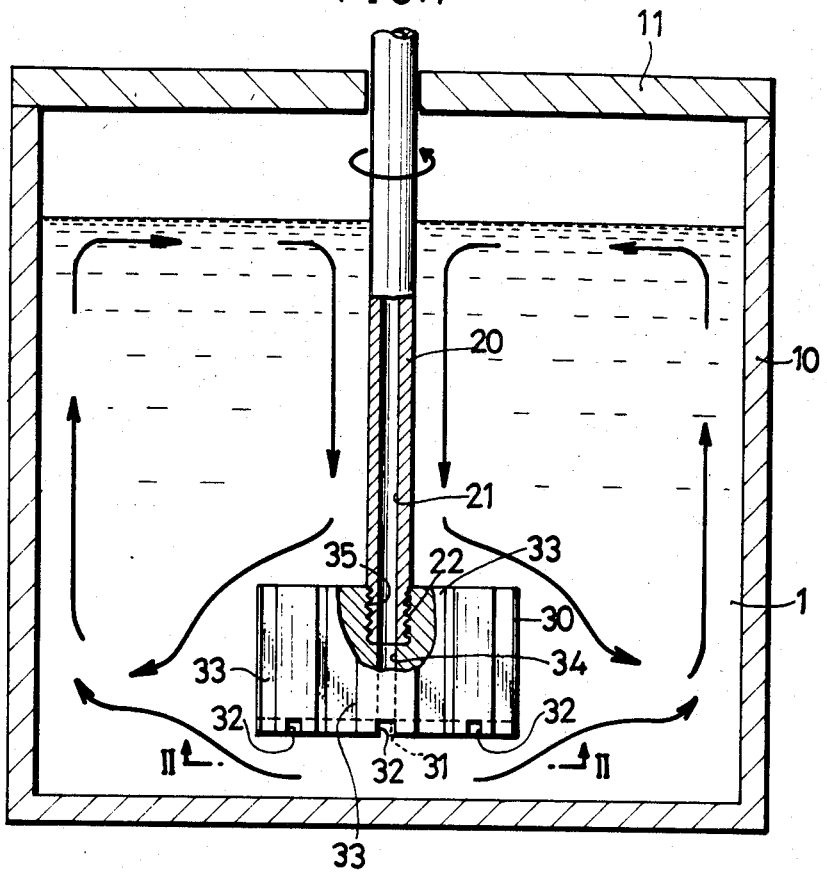
FIG. 1 is a front view partly broken away and showing a first embodiment of the invention with the front side of a container removed.
Figure 2:
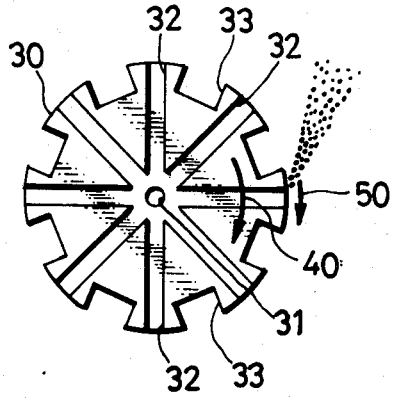
FIG. 2 is a view showing the same as it is seen in the direction of arrows II—II.

With reference to FIGS. 1 and 2 showing a first embodiment of the invention, a liquid 1 such as molten aluminum or aluminum alloy, or a liquid for use in gas-liquid contact process is contained in a rectangular parallelepipedal or cubic container 10. The device comprises a tubular rotary shaft 20 disposed vertically in the container 10 and having a gas channel extending through the shaft axially thereof, and a disk-like, bubble dividing-diffusing rotor 30 fixed to the lower end of the rotary shaft 20 and having at its bottom surface a gas discharge outlet 31 communicating with the gas channel 21.

When the device is to be used for removing hydrogen gas, nonmetallic inclusions and alkali metals from molten aluminum or aluminum alloy, the container 10, rotary shaft 20 and rotor 30 are prepared from a refractory material, such as graphite or silicon carbide, which is inactive to aluminum.

The rotary shaft 20 extends upward through a closure 11 of the container 10 and is rotated by known drive means (not shown) disposed above the container 10. The lower end of the rotary shaft 20 is positioned in the vicinity of the bottom of the container 10 and externally threaded as at 22. The upper end of the gas channel 21 is connected to a known gas feeder (not shown). When the device is to be used for removing hydrogen gas and nonmetallic inclusions from molten aluminum or aluminum alloy, the feeder supplies an inert gas, chlorine gas, or a mixture of chlorine gas and an inert gas. Alternatively, when the device is used for removing alkali metals from molten aluminum or aluminum alloy, the feeder supplies chlorine gas or a mixture of chlorine gas and an inert gas.

The rotor 30 has flat bottom surface and top surface, and a peripheral surface of predetermined height. The rotor 30 is formed in its bottom surface with radial grooves 32 extending from the gas outlet 31 to the peripheral surface and each having an open end at the peripheral surface. A recess in the form of a vertical groove 33 is formed in the peripheral surface between each two immediately adjacent grooves 32, and has an open lower end at the bottom surface and an upper end which is open at the top surface of the rotor 30. A bore 34 vertically extends through the rotor 30 at its center. An approximately half upper portion of the bore 34 is internally threaded as at 35. The externally threaded lower end 22 of the shaft 20 is screwed in the internally threaded portion 35, whereby the rotary shaft 20 is fixed to the rotor 30. The lower end of the bore 34 serves as the gas outlet 31.

When the rotary shaft 20 is rotated about its own axis at a high speed by the drive means, the gas to be injected into the liquid 1 is supplied from the feeder to the gas channel 21. The gas flows from the lower end of the channel 21 through the bore 34 to the outlet 31 at the bottom surface of the rotor 30, from which it is forced out. The gas flows through the grooves 32 toward the peripheral surface of the rotor 30 and strikes against the edges of the groove ends which are open at the peripheral surface, whereupon the gas is made into fine bubbles and released into the liquid 1. When the liquid is water and the gas is Ar gas, the rotational speed of the rotor 30 is represented by an arrow 40, and the speed of flow of water around the rotor 30 by an arrow 50 as shown in FIG. 2. As indicated by arrows in FIG. 1, the fine bubbles released are diffused through the entire body of liquid 1 in the container 10 by the liquid 1 flowing in the centrifugal direction while revolving in the same direction as the rotor 30 owing to the agitating action of the vertical grooves 33. When the device is used for removing hydrogen gas and nonmetallic inclusions from molten aluminum or aluminum alloy, the hydrogen gas and nonmetallic inclusions in the melt are carried to the surface of the melt by the bubbles of treating gas rising to the melt surface and are removed from the surface. Further when the device is used for removing alkali metals from molten aluminum or aluminum alloy, these metals chemically react with chlorine into chlorides, which rise to the surface of the melt and are removed as slag.

Figure 3:
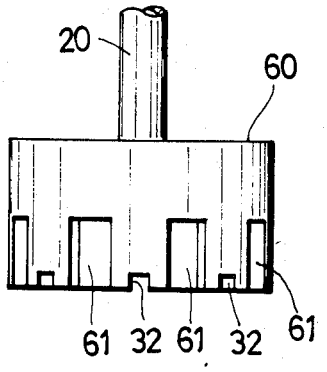
FIG. 3 is a front view showing a modified rotor.

FIG. 3 shows a modification of the rotor. The rotor 60 shown in FIG. 3 has the same construction as the rotor 30 of FIGS. 1 and 2 except that a recess 61 is formed in the peripheral surface of the rotor 60 between the open ends of each two immediately adjacent radial grooves 32 and has an open lower end at the bottom surface of the rotor 60. When the device of FIGS. 1 and 2 is used with the rotor 30 replaced by the rotor 60 shown in FIG. 3, finely divided bubbles are released and diffused into the entire body of liquid 1 in the same manner as already stated.

Figure 4:
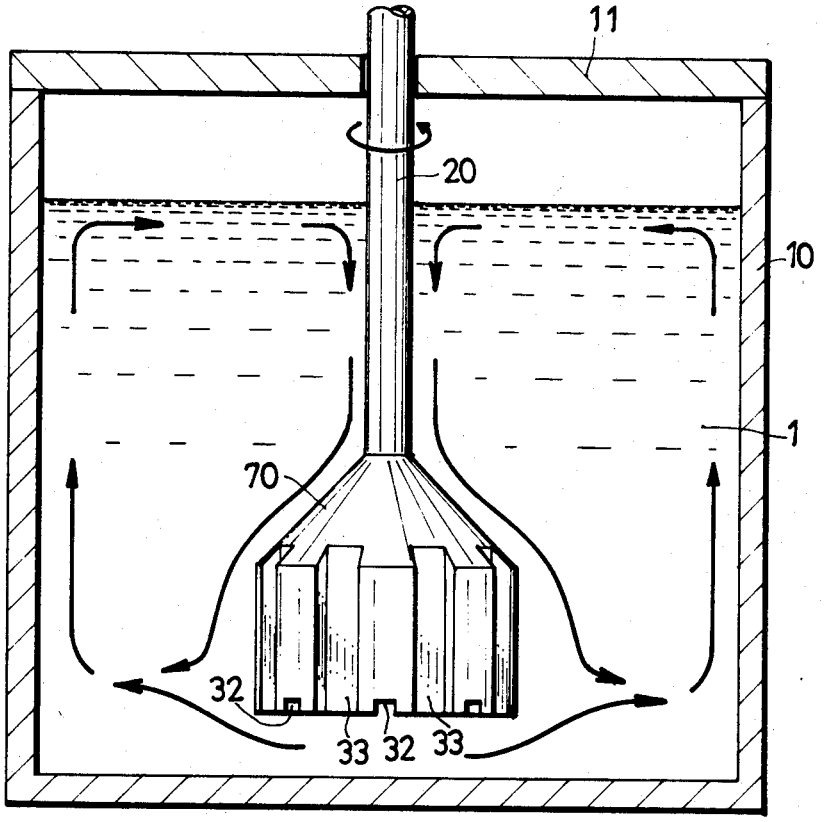
FIG. 4 is a front view partly broken away and showing a second embodiment of the invention with the front side of a container removed.

FIG. 4 shows a second embodiment of the invention having a rotor 70. This embodiment differs from the device of FIGS. 1 and 2 in that the top surface of the rotor 70 is not flat but is a concial surface having a gradually increasing height from its periphery toward the center.

The rotary shaft 20 is rotated by drive means while supplying a gas to the gas channel 21 from a feeder. As in the case of the device of FIG. 1, the gas flows from the lower end of the gas channel 21 through the bore 34 to the gas outlet 31, from which the gas is forced out beneath the bottom of the rotor 70. The gas then flows through the grooves 32 toward the periphery of the rotor 70 and strikes against the edges of the groove ends which are open at the peripheral surface, whereupon the gas is divided into fine bubbles and released into the liquid. The fine bubbles released is entrained in the liquid which is flowing in the centrifugal direction while revolving in the same direction as the rotation of the rotor 70 owing to the agitation of the rotor 70. Because the rotor 70 has a conical surface, the liquid 1 flows as indicated by arrows in FIG. 4, and the finely divided bubbles are diffused through the entire body of liquid 1 within the container 10 more uniformly than is the case with the device of FIG. 1. With the device of FIG. 4, the speed of rotation of the rotor 70 and the speed of flow of the liquid 1 are approximately the same as in the case of the device of FIGS. 1 and 2.

EXAMPLE 1

The device shown in FIGS. 1 and 2 was used. The container 10 was made of a transparent plate and was rectangular parallelepipedal, 50 cm in width and length, and 60 cm in height. The rotor 30 was 17 cm in diameter and 10 cm in thickness. With water placed in the container 10, Ar gas was supplied to the gas channel 21 from the gas feeder at a rate of 30 liters/min or 60 liters/min while rotating the rotary shaft at a speed of 1000 r.p.m. The bubbles diffused into the water were checked for size and state of diffusion. Table 1 shows the result.

EXAMPLE 2

The procedure of Example 1 was repeated under the same conditions except that the rotor was replaced by the one shown in FIG. 3 (17 cm in diameter and 10 cm in thickness). The bubbles diffused into the water were checked for size and state of diffusion. Table 1 shows the result.

COMPARATIVE EXAMPLE 1

Figure 5:
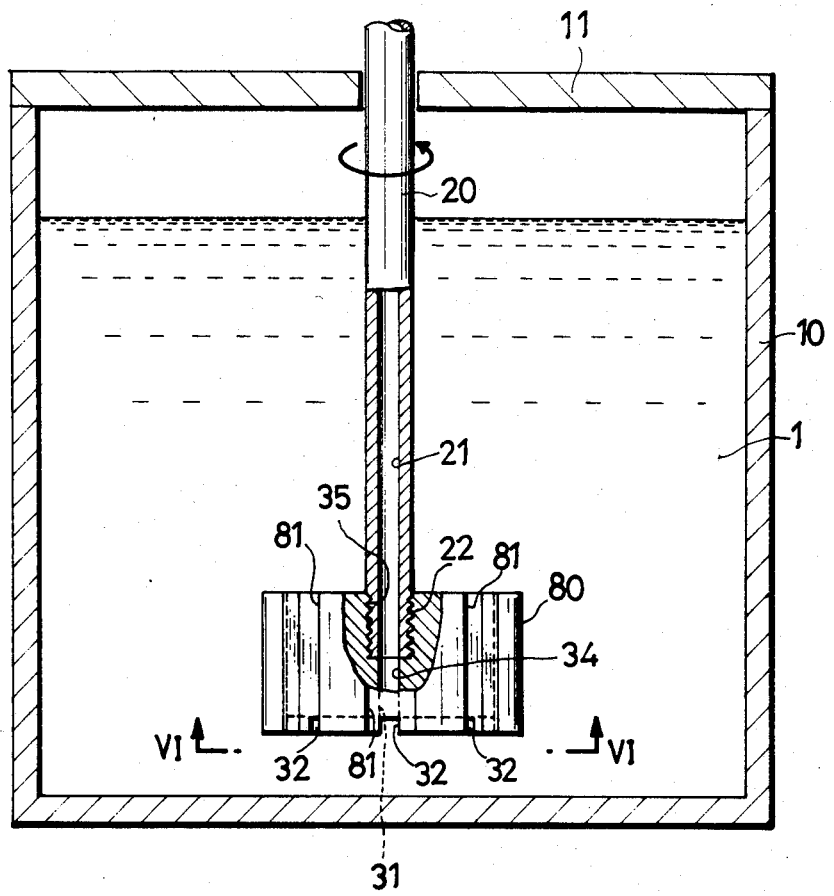
FIG. 5 is a front view partly broken away and showing a device used for Comparative Examples with a container partly broken away.
Figure 6:
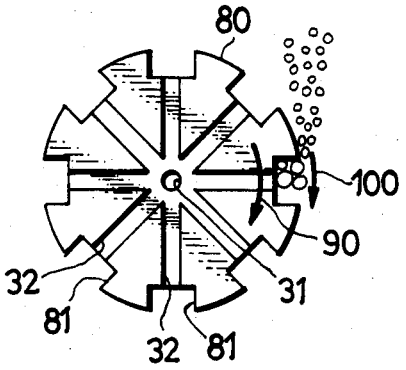
FIG. 6 is a view showing the same as it is seen in the direction of arrows II—II.

The device shown in FIGS. 5 and 6 was used. This device differs from the one shown in FIGS. 1 to 2 in that no recess is formed in the peripheral surface of a rotor 80 between the open ends of radial grooves 32 and that recesses in the form of vertical grooves 81 are formed in the peripheral surface in coincidence with the open ends of the radial grooves 32. Each vertical groove 81 has an open upper end at the top surface of the rotor 80 and an open lower end at the bottom surface thereof. With the exception of this feature, the device has the same construction as the one shown in FIGS. 1 and 2. The container and rotor are the same as those used in Example 1 in size.

The bubbles diffused into water in the same manner and under the same conditions as in Example 1 were checked for size and state of diffusion. Table 1 shows the result. The rotational speed of the rotor 80 used is represented by an arrow 90, and the speed of flow of the water by an arrow 100 in FIG. 6.

TABLE 1

| | Supply of Ar gas | | | |
|---|---|---|---|---|
| | 30 liters/min | | 60 liters/min | |
| | Bubble size (mm) | State of diffusion | Bubble size (mm) | State of diffusion |
| Example | | | | |
| 1 | 0.5–2 | Good | 1–3 | Good |
| 2 | 0.5–2 | " | 1–3 | " |
| Comp. Ex. | | | | |
| 1 | 1–3 | " | 4–10 | Poor |

Note:
"Good" means uniform diffusion of bubbles through the entire body of water.
"Poor" means concentration of bubbles in the vicinity of the shaft without diffusion.

Table 1 reveals that the device of the invention is superior to the conventional device in bubble dividing and diffusing effects. Comparison of the arrows 40, 50 in FIG. 2 with the arrows 90, 100 in FIG. 6 shows that the use of the rotor of FIGS. 1 and 2 results in a greater difference between the rotational speed of the rotor and the flow speed of the liquid, hence a higher relative speed.

EXAMPLE 3

The device of the invention was used for removing hydrogen gas from molten aluminum alloy.

About 500 kg of molten A6063 ally was placed into a container in the form of a graphite crucible, 60 cm in inside diameter, and maintained at 720° C. A graphite rotary shaft and a graphite rotor (17 cm in diameter and 10 cm in thickness) of the construction shown in FIGS. 1 and 2 were placed in the crucible. Ar gas was supplied to the gas channel at a rate of 30 liters/min for 3 minutes while rotating the shaft at a speed of 700 r.p.m. The amount of hydrogen in the aluminum alloy melt was measured before and after the treatment. Table 2 shows the result.

COMPARATIVE EXAMPLE 2

The same procedure as in Example 3 was repeated under the same conditions except that a graphite rotor of the shape shown in FIGS. 5 and 6 was used. The amount of hydrogen in the aluminum alloy melt was measured before and after the treatment. Table 2 shows the result.

TABLE 2

| | Amount of $H_2$ in Al alloy melt | |
|---|---|---|
| | Before treatment | After treatment |
| Example 3 | 0.41 c.c./100 g | 0.08 c.c./100 g |
| Comp. Ex. 2 | 0.38 c.c./100 g | 0.14 c.c./100 g |

Table 2 shows that the device of the present invention is superior to the conventional device in bubble dividing and diffusing effects and consequently in hydrogen gas removal effect.

The device of the invention is not only useful for removing hydrogen gas, nonmetallic inclusions and alkali metals from aluminum or aluminum alloy melt but is usable also for promoting chemical reactions in gas-liquid contact processes and for other purposes.

The present invention may be embodied differently without departing from the spirit and basic features of the invention. Accordingly the embodiments herein disclosed are given for illustrative purposes only in every respect and are in no way limitative. It is to be understood that the scope of the invention is defined by the appended claims rather than by the specification and that all alterations and modifications within the definition and scope of the claims are included in the claims.

What is claimed is:

1. A bubble releasing-diffusing device for releasing a gas into a liquid in the form of finely divided bubbles and diffusing the bubbles through the entire body of the liquid, comprising:

a rotary shaft to be disposed in the liquid substantially vertically and rotatable about its own axis, the rotary shaft having a gas channel extending therethrough axially of the shaft, and a rotor fixed to the lower end of the rotary shaft and having at a bottom surface thereof a gas discharge outlet communicating with the gas channel, the rotor having radial grooves in the bottom surface thereof extending from the gas outlet to the peripheral surface of the rotor and each having an open end at the peripheral surface, and a recess being formed in the peripheral surface of said rotor between the open ends of immediately adjacent grooves and having an open lower end at the bottom surface.

2. A device as defined in claim 1 wherein the recess in the peripheral surface of the rotor is a groove having an open upper end at the top surface of the rotor and an open lower end at the bottom surface of the rotor.

3. A device as defined in claim 1 wherein the recess in the peripheral surface of the rotor has an upper end positioned at an intermediate portion of the height of the rotor peripheral surface.

4. A bubble releasing-diffusing device for releasing into molten aluminum or a molten aluminum alloy finely divided bubbles of a melt treating gas for removing hydrogen gas and impurities from the melt and diffusing the bubbles through the entire body of the melt, comprising:

a rotary shaft to be disposed in the melt substantially vertically and rotatable about its own axis, the rotary shaft having a gas channel extending therethrough axially of the shaft for passing the treating gas therethrough, and a rotor fixed to the lower end of the rotary shaft and having at a bottom surface thereof a treating gas discharge outlet communicating with the gas channel, the rotor having radial grooves in the bottom surface thereof extending from the gas outlet to the peripheral surface of the rotor and each having an open end at the peripheral surface, and a recess being formed in the peripheral surface between the open ends of immediately adjacent grooves and having an open lower end at the bottom surface.

5. A device as defined in claim 4 wherein all surfaces in contact with said melt treating gas are resistant to the melt treating gas.

* * * * *